US005924521A

United States Patent [19]

Crockett

[11] Patent Number: 5,924,521

[45] Date of Patent: Jul. 20, 1999

[54] MARINE VESSEL OVERBOARD EMERGENCY SYSTEM

[76] Inventor: Peter A. Crockett, 25 Lawrence Lano St., South Portland, Me. 04106

[21] Appl. No.: 08/731,087

[22] Filed: Oct. 9, 1996

[51] Int. Cl.[6] ..... E04G 3/00

[52] U.S. Cl. ..... 182/95; 182/106; 182/116; 182/163

[58] Field of Search ..... 182/82, 83, 84, 182/85, 86, 90, 91, 92, 95, 106, 115, 116, 124, 163

[56] References Cited

U.S. PATENT DOCUMENTS

| | | | |
|---|---|---|---|
| 597,706 | 1/1898 | Brown | 182/95 |
| 988,593 | 4/1911 | Poss | 182/95 |
| 1,026,167 | 5/1912 | Jefferson | 182/95 |
| 2,485,413 | 10/1949 | Ross | 228/60 |
| 2,536,966 | 1/1951 | Teller | 182/95 |
| 3,134,999 | 6/1964 | Reynolds | 14/71 |
| 3,136,384 | 6/1964 | Sweeney et al. | 182/106 |
| 3,180,451 | 4/1965 | Patterson | 182/85 X |
| 3,195,680 | 7/1965 | Thornburg et al. . | |
| 3,794,140 | 2/1974 | Sell . | |
| 3,892,290 | 7/1975 | Lang . | |
| 4,293,967 | 10/1981 | Ord | 14/71.1 X |
| 4,401,183 | 8/1983 | Schler | 182/95 X |
| 4,538,314 | 9/1985 | Baranowski . | |
| 4,724,925 | 2/1988 | Ritten . | |
| 4,733,752 | 3/1988 | Sklar | 182/95 X |
| 4,823,910 | 4/1989 | Day | 182/106 X |
| 4,848,517 | 7/1989 | Broyles, III | 182/106 X |
| 4,989,691 | 2/1991 | Wilkerson et al. | 182/70 |
| 5,123,372 | 6/1992 | Kobayashi et al. | 114/362 |
| 5,224,437 | 7/1993 | Stanescu | 182/95 X |
| 5,341,897 | 8/1994 | Gross | 182/91 X |
| 5,582,268 | 12/1996 | Heberlein | 182/115 X |

*Primary Examiner*—Daniel P. Stodola
*Assistant Examiner*—Richard M. Smith
*Attorney, Agent, or Firm*—Thomas L. Bohan

[57] ABSTRACT

A marine vessel ladder system that is primarily used for overboard emergency situations. The ladder system is collapsible and separable into two pieces with one piece substantially smaller than the other. The smaller piece serves both as a retainer to hold the larger piece in a folded, stowed position and also as a connector to fasten the larger piece to a customized area along an edge of the vessel's deck. The ladder system is deployable by one deckhand and includes vertically oriented upper and lower ladder sections with a horizontally oriented grate section therebetween. Fixed vertical railings and collapsible side railings are provided for assistance in ascending and descending the ladder system. Optional safety straps are provided to secure the system prior to and during use.

10 Claims, 4 Drawing Sheets

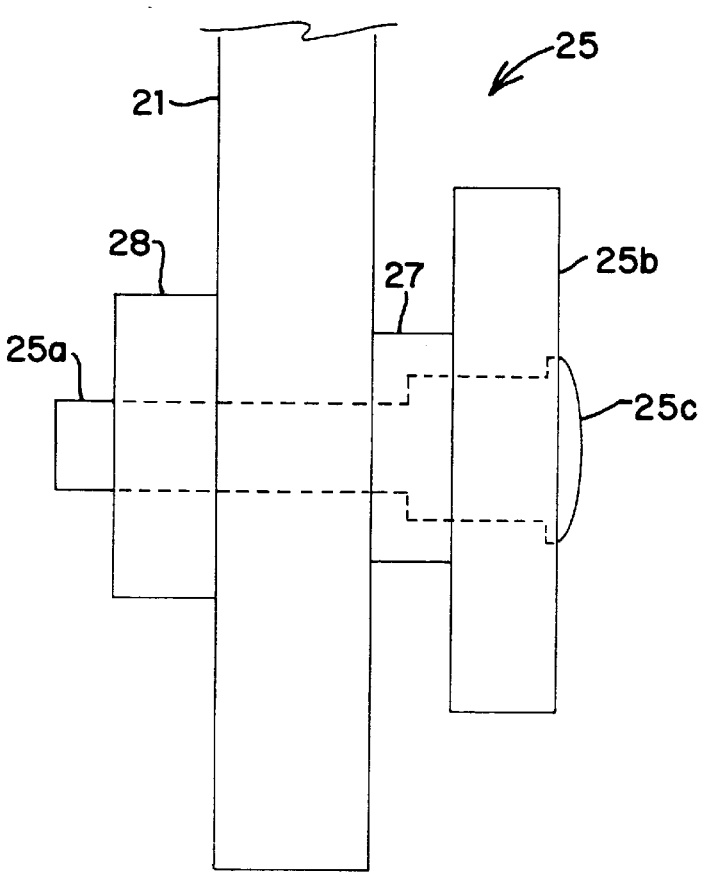
FIG 2A
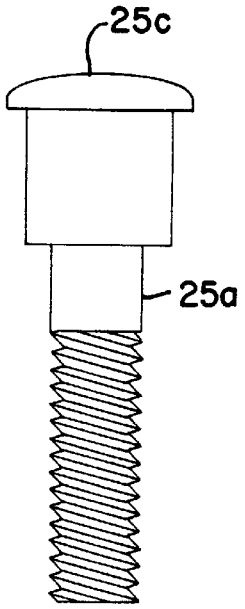
FIG 2B
FIG 2C
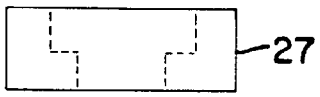
FIG 2D
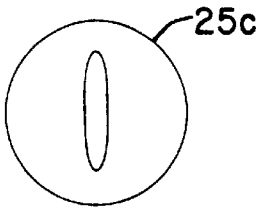

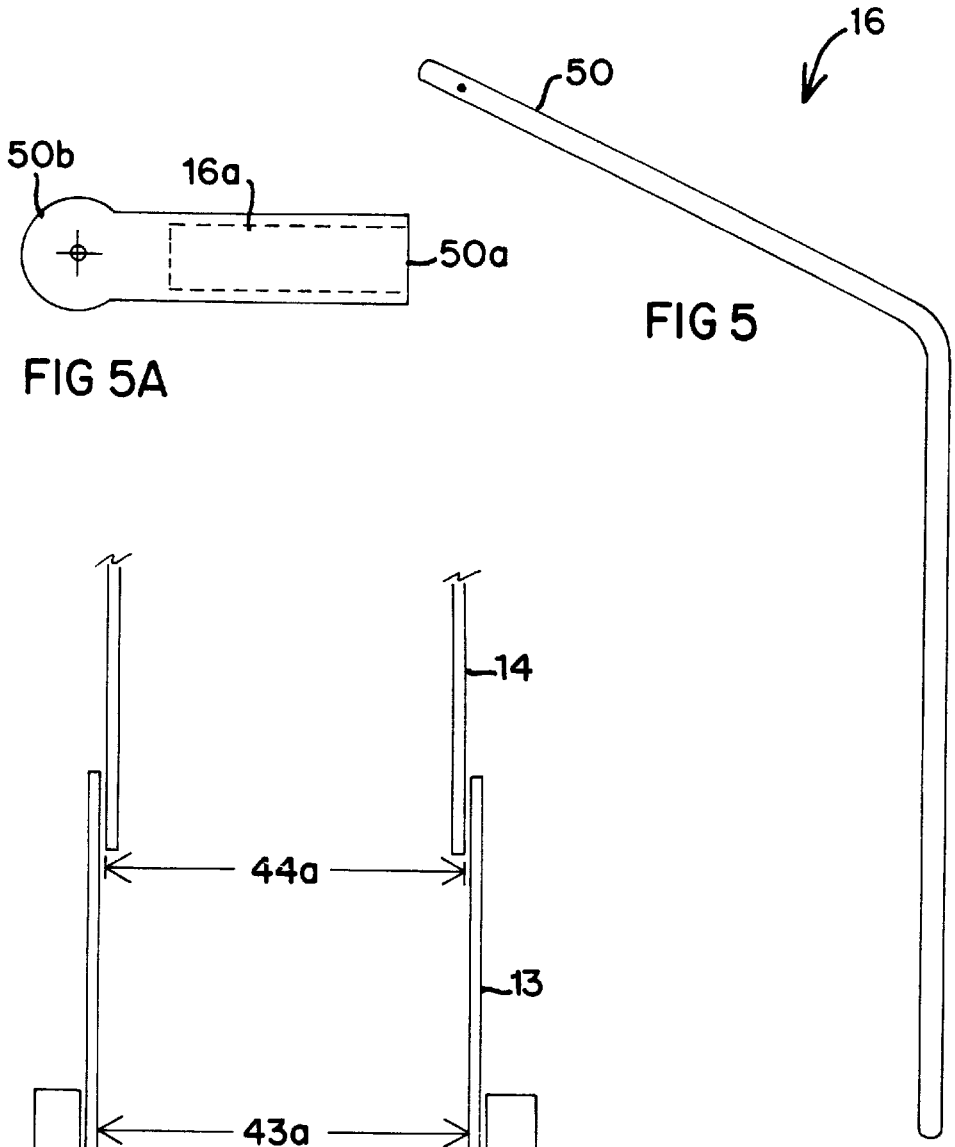
FIG 5
FIG 5A
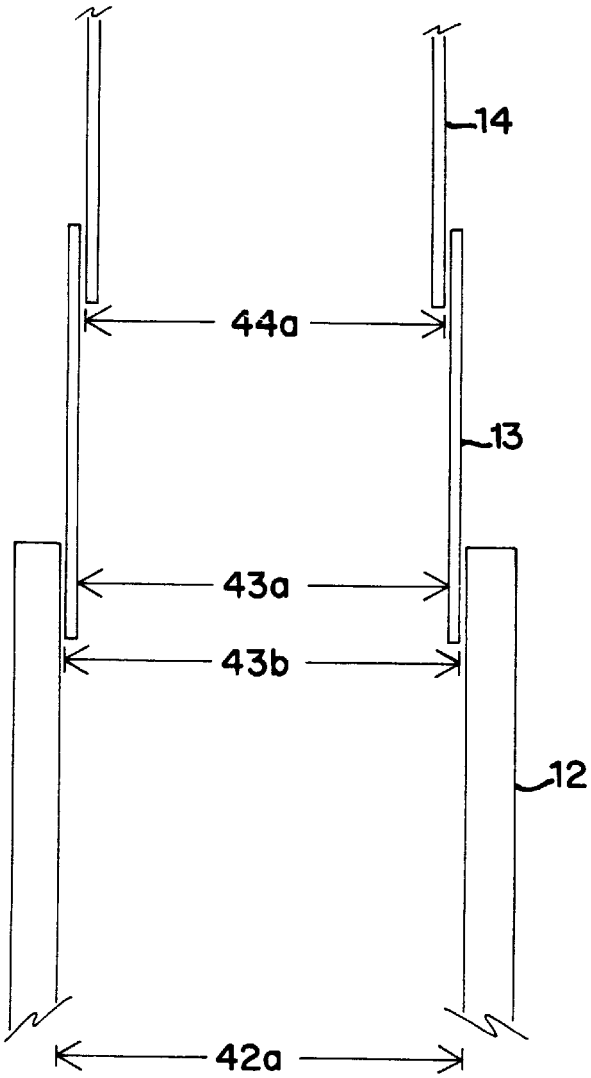
FIG 4

MARINE VESSEL OVERBOARD EMERGENCY SYSTEM

BACKGROUND OF THE INVENTION

1. Field of Invention

The present invention relates to the field of nautical safety devices. More particularly, the present invention relates to a device for providing emergency transit between a marine vessel and the surrounding water. More particularly yet, the present invention involves a modular, foldable ladder, where the ladder is portable and stowable aboard the vessel and deployable over a side of the vessel to provide safe transit between the water and the deck of the vessel.

2. Description of Prior Art

Throughout the long history of marine vessels, there have been the inherent hazards of water. For numerous reasons, it has been and continues to be necessary to provide some means by which an individual may both safely enter the water from a deck of a vessel and safely access the deck of the vessel from the water. Accordingly, various designs of ladder structures are found throughout the art of nautical devices. Many such designs are permanently mounted along the periphery of the vessel, typically supported by some portion of the vessel's hull. These types of ladder structures may be pivotally or statically mounted. Alternatively, many such ladder structures are removably mountable along the vessel's periphery. It is within this removably mountable category of ladder structure that the present invention resides.

In the field of nautical safety devices, there have been attempts, with varying degrees of success, to facilitate transit between the deck of a vessel and the water surrounding the vessel by providing a removably mounted ladder structure. In general, the complexity of such efforts has undercut whatever advantages they might otherwise offer during both emergency and non-emergency situations. Indeed, during typical nautical emergencies the time and effort involved in deploying and using complex and inefficient ladders is self-defeating. Typical non-folding ladders that are not welded, or otherwise fixed, to the vessel are usually cumbersome, heavy, and not readily stowable. Deployment of such prior-art ladders is difficult at best for one person working alone and valuable time is lost during emergency situations when a cumbersome or complex ladder is deployed. Some prior-art ladders even pose a hazard themselves when deployed because they are shaped and/or mounted in such a way that causes its elements to catch, foul, or snare lines or pier structures. Other prior-art nautical ladder structures have their own disadvantages.

One related prior-art nautical ladder is that of Lang (U.S. Pat. No. 3,892,290), which has two-piece and three-piece foldable configurations. In both configurations, there is included a set of parallel rails that have end-hooks latchable onto corresponding mounts along a side of a boat. Deployment of the Lang ladder involves holding it in a precarious position near the side of the boat so that it can be attached to the mounts. This deployment technique makes the risk of losing the ladder into the water high. As well, Lang fails to provide any rails or guides to assist anyone using the ladder. While a guide-chain is provided in one configuration, this is far from an ideal grasping element for assistance. Typically, chains pinch fingers and thus present the danger of a user losing his grip while on the ladder. Accordingly, Lang fails to provide a safe nautical ladder.

Other nautical ladders exist that are deficient for the same reasons noted in regard to the Lang device. A general defect of prior-art nautical ladders is that they are not suitable for emergency situations where medium to large vessels are concerned. Indeed, prior-art nautical ladders of the removably mounted type are typically designed for use in small recreational boats. Mounting such nautical ladders on a large vessel—such as a ferry—where the deck is much farther from the water becomes difficult to impossible. This is because the requisite length of ladder typically precludes stowability aboard boats. Even telescoping or otherwise extendable designs found in the prior-art do not provide adequate or safe transit between a deck and the water. Due to wave swells and the fixed height of the sides of the boat, the distance between the deck and the water can range from four up to eight feet or more. Concurrent with the development of the prior-art nautical ladders described above, other ladders have been developed with the goal of quickly facilitating transit between water and a boat. Four representative prior-art devices are those of Ritten (U.S. Pat. No. 4,724,925), Baranowski (U.S. Pat. No. 4,538,314), Sell (U.S. Pat. No. 3,794,140), and Thornburg et al. (U.S. Pat. No. 3,195,680).

The Ritten device is a nautical ladder having a ladder section and a mount section. The mount section has a step unit and a mount unit. The step unit is a pair of tubular siderails that carry flat tread steps. The mount unit is a pair of spaced-apart, tubular sections rotatably connected to the step unit. Mounting members, into which such tubular sections fit, permit the ladder to be mounted on a topside surface of a boat while supporting the ladder in its operating orientation. Ritten exhibits several flaws, including, most importantly, a lack of any guides or railings to assist a user. Further, aside from the small tread steps, Ritten does not provide any platform near water-level that would be a suitable landing for exhausted or injured individuals, as would be needed during emergency rescue situations. Yet further, the rigid ladder section of Ritten is neither compact for better stowability nor extendable for use on a large boat such as a ferry. Accordingly, Ritten fails to provide a nautical ladder that is both suitably safe and quick to set up during emergency situations on a large boat.

Baranowski includes a nautical boarding ramp similar to Ritten but having adjustable features that make it foldable. While the ramp of Baranowski also provides a landing platform, it does not provide sufficient extendibility to the water surface such as is needed for use on large boats with decks high above the water. Also, no safety rails or guides are shown for use with the ramp. Indeed, due to its cumbersome design, the ramp itself may be easily dropped overboard when a user attempts to hook it to the side of the boat. Therefore, Baranowski is not suitable for emergencies on large boats where safety and speedy setup are required.

Sell includes a boat ladder similar to the prior-art mentioned above but one that has guide rails. While a landing platform is shown as a component of the Sell device, it is located at boat-deck level and only one step is provided therebelow for access to and from the water. Although this design is suitable for recreational use on a small boat, it fails to provide a suitable transit between the water and a large boat. As well, Sell suffers from the deficiency seen throughout the prior-art, the absence of deployment means that is safe for both the rescuer and the rescued with minimal risk of dropping the ladder overboard.

Similar to the device of Sell, the boarding platform of Thornburg at al. includes a boat ladder for a small watercraft having a platform landing at deck-level and a foldable step therebeneath. Thornburg et al. does not, however, provide any guides or rails. Again, although this design is suitable for recreational use on a small boat, it fails to provide suitable transit between the water and a large boat during emergencies. Thornburg at al. suffers from the deficiency pervasive throughout the prior-art: the absence of quick, easy, and safe deployment with reduced risk of losing the ladder overboard.

Accordingly, the prior art fails to provide any nautical ladders suitable for quick and safe assembly and use—especially in emergency situations. Therefore, what is needed is a nautical ladder that is truly suitable for emergency use. What is also needed is such a device that is lightweight, portable, and of sturdy design. Further, what is needed is such a device that enables fast and safe utilization with a large boat, such as a ferry. Still further, what is needed is such a device that is readily deployable by a sole deckhand with minimal risk of dropping or otherwise losing the device overboard. What is also needed is that the nautical ladder system be mounted in such a way so as to eliminate any protrudances that can catch, foul, or snare lines or pier structures. Also, what is needed is such a nautical ladder system that is both foldable and compact so as to provide easy stowing.

SUMMARY OF THE INVENTION

It is an object of the present invention to provide a marine vessel overboard emergency system that includes a lightweight, portable, and sturdy ladder suitable for quick and safe assembly by a sole deckhand in emergency situations. While the instant invention is primarily directed to emergency situations such as that of an individual falling overboard from a marine vessel into the surrounding water, it may also be utilized for a variety of non-emergency purposes including, but not limited to, water access during recreational boating, snorkeling, scuba-diving, water-skiing, swimming, and passage between two vessels. Another object of the present invention is to provide such a ladder that is readily deployable for use on a large boat—e.g., a ferry—with minimal risk of dropping, or otherwise losing, the device overboard. Yet another object of the present invention is to provide such a nautical device that is mounted in such a way so as to eliminate any elements that might otherwise catch, foul, or snare lines or pier structures. Still another object of the present invention is to provide such a nautical ladder system that is foldable and compact so that it is easily stowable.

The marine vessel overboard emergency system of the present invention includes a three-section folding ladder with guide rails, a mounting frame, and a slightly modified deck area on the vessel where the system is to be made available. Although, this discussion focuses on use of the present invention during emergency situations such as when a passenger falls off a ferry into water, any similar situation requiring passage between the deck and the water is applicable. Also, for purposes of illustration, the present invention is discussed in terms of being machined from aluminum; however, it should be understood that the instant invention is not intended to be limited to machined aluminum. Rather, any suitable method of fabrication and material may be used that is sufficiently dependable, sturdy, and lightweight.

In general, the marine vessel overboard emergency system of the present invention is designed to unobtrusively stow in whatever place other emergency nautical devices aboard a boat are located or anywhere else that is out of the way, but nevertheless readily accessible. This is accomplished by the introduction of a collapsibly folding feature. While stowed or transported, the system is compact. The system has a three-sectioned ladder portion that includes an upper ladder having rungs, a middle platform, and a lower ladder having rungs. All three sections are hinged together and have nesting widths so that the lower ladder may be folded into the middle platform and, in turn, both of these may be folded into the upper ladder. The system also has a mounting frame separable from the ladder portion that connects the ladder portion to a modified deck area of a marine vessel.

The upper ladder has two parallel side rails that include fixed elongated hand-grips. A lateral guide is movably mounted on each hand-grip so that the lateral guide may slide along the hand-grip and pivot on one end vertically and horizontally. This movement of the lateral guides both enhances stowability via increased foldability and allows vertical slack in situations where wave swells cause someone grasping the lateral guides to be dipped into and out of the water. The other end of the lateral guide is connectable to orifices located on the lower ladder. The two parallel side rails of the upper ladder are formed by three layered segments that provide an elongated slot therein. The mounting frame has two rollers that are connectable to the elongated slot of the upper ladder. The mounting frame also has two footings that are securable in foot-receiving slots. According to the instant system, the foot-receiving slots are placed in the deck. These foot-receiving slots have openings that are flush with the deck surface. (This is the only modification made to the deck area.) As the particular deck surface will include a portion of a doorway, there will usually be a raised threshold area. The mounting frame is shaped such that it is recieved flush within the threshold. Although two footings and two related foot-receiving slots are discussed herein, any number of such footing/slot pairs may be utilized so as to suitably secure the mounting frame and ladder portion to the boat deck.

For deployment, a deckhand will first remove the folded ladder portion hitherto secured to an interior wall of the vessel by the mounting frame. The mounting frame is carried to the modified deck area and placed flush within the threshold. The deckhand will then carry the ladder portion to the modified deck area and set the ladder portion adjacent to the mounting frame. Alternatively, the ladder portion may be slidably moved along the deck, via its rounded edges, to its placement adjacent to the mounting frame. Optional safety straps may be employed at this point between the vessel and either or both the ladder portion and mounting frame. The ladder portion is next unfolded to its open and locked position, seated on the rollers, and then rolled along the rollers for deployment alongside the boat. Because the rollers securely grasp the inside of the elongated slot when the ladder portion is on the deck, there is no opportunity for the ladder portion to be dangled from the deck and no possibility that it will be lost overboard during proper deployment.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

BRIEF DESCRIPTION OF THE DRAWINGS

FIGS. 2*a*, 2*b*, 2*c*, and 2*d* are close-up views of one of the rolling elements of the mounting frame portion as shown in FIG. 2 and disassembled.

FIG. 4 is a schematic view of the upper ladder, middle platform, and lower ladder as shown in FIG. 1 representing the nesting characteristics of the present invention.

FIG. 5 is a side view of the lower railing of the present invention as shown in as shown in FIG. 1.

FIG. 5*a* is a side view of the end element that is connectable to the lower rail element of FIG. 5 as shown attached in FIG. 1.

DETAILED DESCRIPTION OF THE PREFERRED EMBODIMENT

Figure 1:
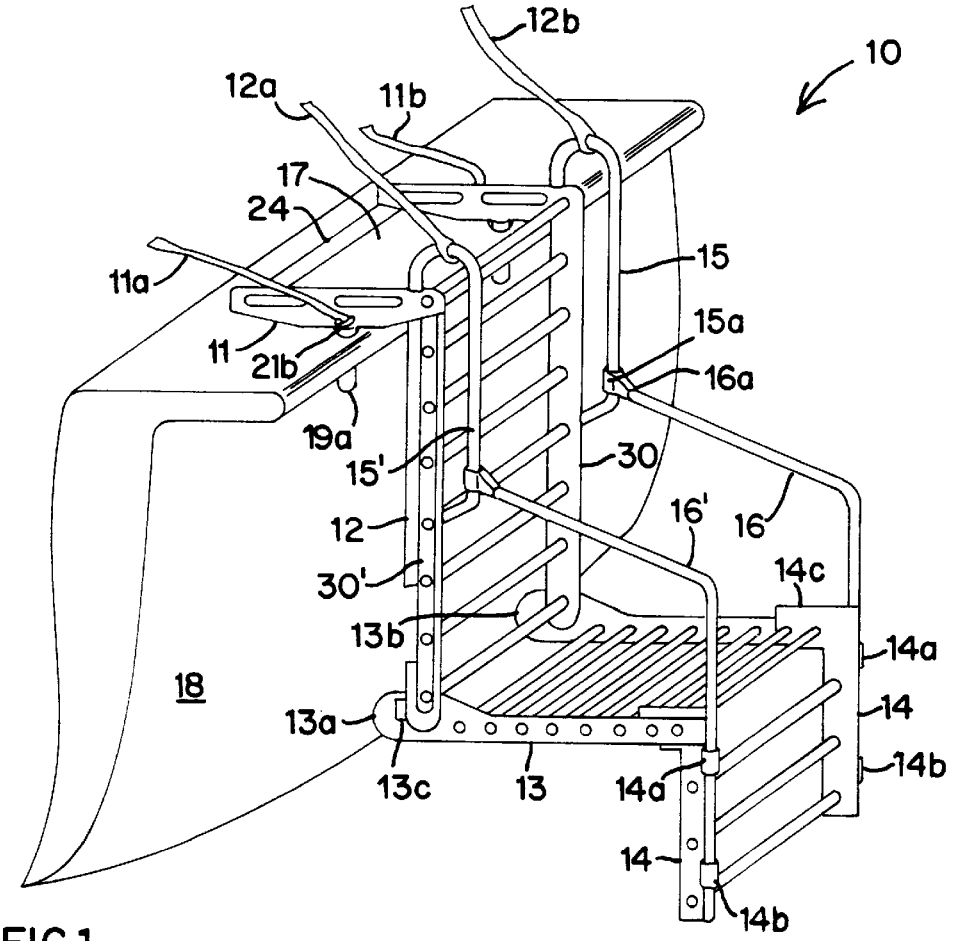
FIG. 1 is a perspective view of a marine vessel overboard emergency system in accordance with the preferred embodiment of the present invention positioned on a cut-away portion of a ferry deck.

In FIG. 1, a marine vessel overboard emergency system 10 is shown according to the preferred embodiment of the present invention. The system 10 includes an upper ladder 12 that has two hand-grips 15, 15' and two rails 30, 30'. The upper ladder 12 is pivotally connected at its lower end to a middle platform 13 which, in turn, is pivotally connected to a lower ladder 14. While these connections are pivotable, stop-elements 13*c* (one hidden) make certain that upper ladder 12 and middle platform 13 are angled at 90 degrees to one another. Hook-elements 14*c* (one hidden), likewise, make certain that the lower ladder 14 and the middle platform 13 are angled at 90 degrees to one another. Lower ladder 14 includes two pairs sleeves 14*a* and 14*b* and is connected to the middle platform 13 such that the lower ladder 14 is set off from a vessel 18. Each of two lateral guides 16, 16' is movably connected between a respective hand-grip 15, 15' and the lower ladder 14. For clarity, only the right side of the system 10 will be referenced hereinafter with respect to FIG. 1; however, it should be understood that the system 10 is symmetrically constructed.

Also as shown in FIG. 1, the sleeve 14*a* secures the lateral guide 16 in position on the lower ladder 14. However, the lateral guide 16 is both vertically and horizontally pivotable via a hinge 16*a* and slidable along hand-grip 15 via slider 15*a* when not secured in sleeve 14*a*. A mounting platform 11 is connected to the upper ladder 12 via a pair of rollers 25 and 26 (shown in FIG. 2) and, in turn, the mounting platform 11 is secured in a modified deck section 17 of the vessel 18. Cross bar 24 of the mounting platform 11 is shaped so that the cross bar 24 may be received within a typical threshold (not shown). The cross bar 24 lying flush within the threshold further prevents sliding movement of the mounting frame 11. Optional platform-safety-straps 11*a*, 11*b* and ladder-safety-straps 12*a*, 312*b* are also shown attached to the system 10. These optional straps 11*a*, 11*b* and 12*a*, 12*b* secure the system 10 to a suitable part of the vessel 18 such as inside rails (not shown) in order to prevent any chance that the system 10 is lost overboard.

Figure 2:
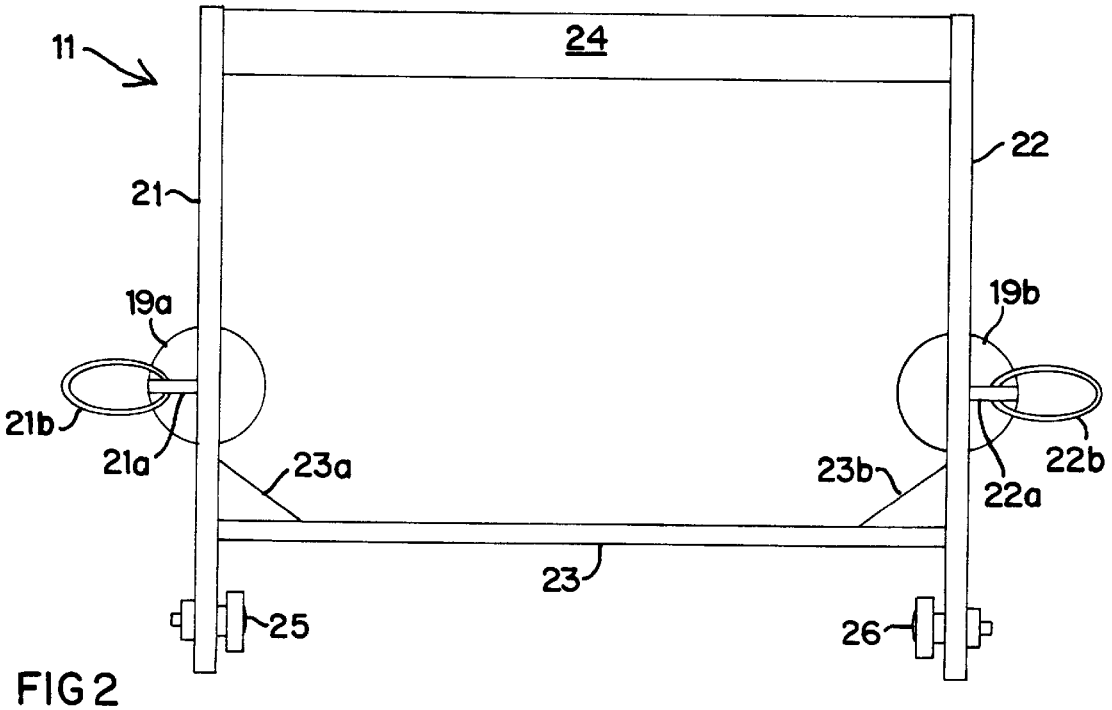
FIG. 2 is a top view of the mounting frame portion of the invention as shown in FIG. 1.

FIG. 2 is a top view of the mounting platform 11 detached from the system 10 of FIG. 1. The mounting platform 11 consists primarily of sides 21, 22 and cross-bars 23, 24 all held together via welding or any suitably strong method of connection. Cross-bar 23 is preferably shaped as a rod, while cross-bar 24 is preferably shaped as a plate. Reinforcements 23*a* and 23*b* add strength to the mounting platform 11. Footings 19*a* and 19*b* are provided perpendicularly affixed to sides 21 and 22, respectively. The footings 19*a* and 19*b* are preferably cylindrical and include lateral reinforcements 21*a* and 22*a* attached, respectively, between sides 21 and 22 and insides of footings 19*a* and 19*b*. Rings 21*b* and 22*b* are shown placed through each reinforcement 21*a* and 22*a*, respectively. Rings 21*b* and 22*b* provide a connection point on the mounting platform 11 for the optional frame-safety-straps 11*a*, 11*b*, as shown in FIG. 1, which are secured to the vessel 18 at some suitable location such as an inside railing (not shown). Because the mounting platform 11 is minimized in its number of parts and hence complexity, its extent and (more importantly) its weight are kept to a minimum. Rollers 25 and 26 are identical and are affixed at ends of sides 21 and 22, respectively.

In FIG. 2*a*, roller 25 is shown in close-up detail. Roller 25 includes a bearing 25*b*, a bushing 27 and a nut 28 held upon a bolt 25*a* that passes through side 21. The bolt 25*a* is formed with a slotted head 25*c*. The bolt 25*a* includes dimensions that allow the bearing 25*b* to be press-fit to the bolt 25*a*. FIGS. 2*b*, 2*c*, and 2*d* respectively, are detailed views of the bolt 25*a*, bushing 27 and slotted head 25*c* as shown in FIGS. 2 and 2*a*.

Figure 3:
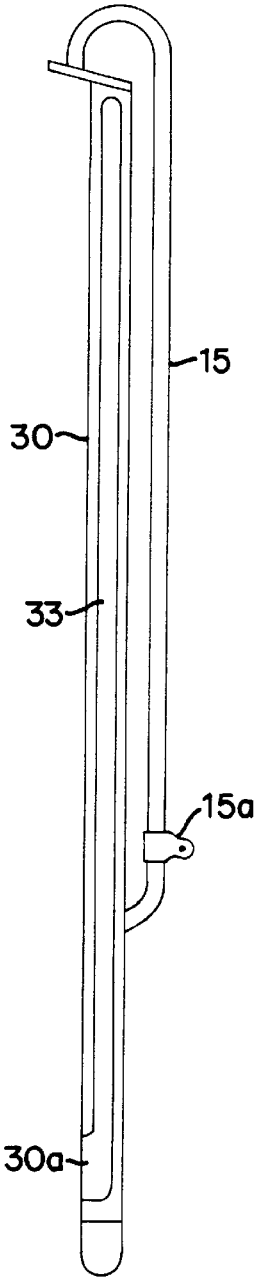
FIG. 3 is a side view of one of the two rail sections of the upper ladder section of the invention as shown in FIG. 1.
Figure 3A:
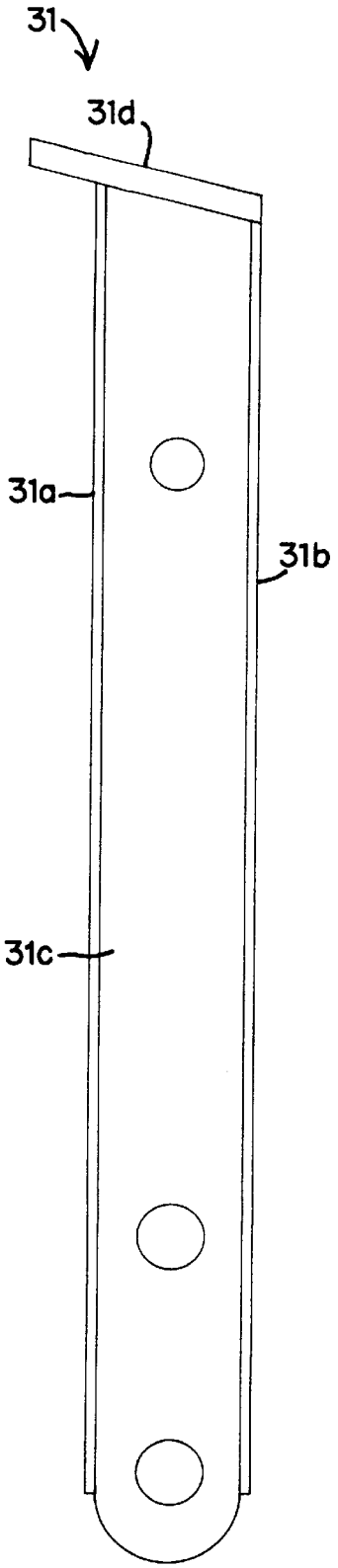
FIG. 3*a* is a side view of the first layer of one of the rail sections of the top ladder section as shown in FIG. 3.
Figure 3B:
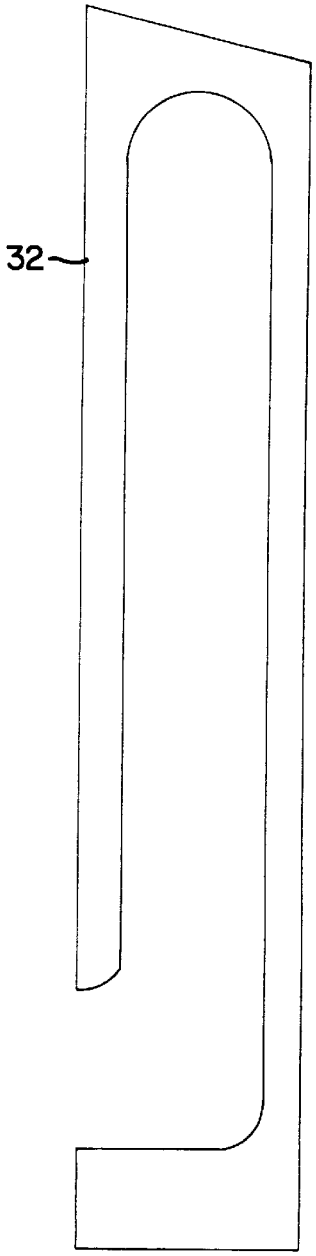
FIG. 3*b* is a side view of the second layer of one of the rail sections of the top ladder section as shown in FIG. 3.

FIG. 3 is an enlarged side view of the rail 30 of one of the two sides of the upper ladder 12 as shown in FIG. 1. The rail 30 has a first section 31 (shown in FIG. 3*a*) upon which a second section 32 (shown in FIG. 3*b*) is placed. Hand-guide 15 is attached to the first section 31. While the first section 31 and the second section 32 are preferably welded together, any suitable method of strong connection may be used. With reference to FIGS. 3, 3*a*, and 3*b*, the first section 31 includes a rear side 31*a* and a front side 31*b* and a base plate 31*c*. Rear side 31*a* and front side 31*b* are constructed to be perpendicular to the base plate 31*c*. A top-plate 31*d* is attached to one end of the first section 31 and welded to the edges of base plate 31*c* as well as to rear side 31*a* and front side 31*b*. The top-plate 31*d* also serves to accept the combined load of the upper ladder 12, middle platform 13, and lower ladder 14 together with any individuals using the system 10. The hand-grip 15 is welded to the top plate 31*d* and the side 31*b*. The second section 32 is welded or otherwise attached to the first section 31 at the edges of rear side 31*a* and front side 31*b* to form an elongated box-like configuration that includes an elongated slot 33 and a slot opening 30*a*. A sliding fitting 15*a* is mounted on hand-grip 15 and will be discussed with reference to FIGS. 5 and 5*a*.

FIG. 4 is a schematic representation that shows the general relationship among the upper ladder 12, the middle platform 13, and the lower ladder 14 shown in FIG. 1. FIG. 4 is oriented from the perspective of standing on-deck looking down. FIG. 4 illustrates the relative dimensions that allow the system 10 shown in FIG. 1 to be nestingly folded so that the lower ladder 14 folds into the middle platform 13, which, in turn, folds into the upper ladder 12. In FIG. 4, this nesting arrangement is seen where the middle platform 13 has an inner width 43*a* that is just greater than an outer width 44*a* of the lower element. Similarly, the middle platform 13 has an outer width 43*b* that is just less than an inner width 42*a* of the upper ladder 12. Therefore, lower ladder 14 may be nested entirely within the middle platform 13 and both may be nested entirely within the upper ladder 12.

FIGS. 5 and 5*a* detail one lateral guide 16 and its respective hinge 16*a* (shown enlarged in FIG. 5*a* for clarity)

as shown in operation in FIG. 1. The lateral guide 16 has a pivot-connection-end 50 that receives the hinge 16*a*. The hinge 16*a* includes an attachment side 50*a* and a pivot-point 50*b*. As seen in FIG. 1, the hinge 16*a* is connected to the sliding fitting 15*a* at the pivot-point 50*b*. The hinge 16*a* is located at the pivot-connection end 50. The hinge 16*a* and lateral guide 16 are preferably connected together by welding at the pivot-connection end 50; however, any suitable method of connection may be used—e.g., removable retaining clips—that allow removal of the lateral guides 16 altogether from the system 10. In operation, this hinging and pivoting arrangement provides foldability for stowing purposes.

Prior to deployment when the system 10 is stowed, the folded ladder portion (12, 13, and 14) is secured to an interior wall or other suitable location aboard the vessel 18 by the mounting frame 11. Deploying the system 10 requires first removing the mounting frame 11, optionally securing frame-safety-straps 11*a*, 11*b* between the mounting frame 11 and the vessel 18, and placing the mounting frame 11 into position in the modified deck area 17 so that the cross bar 24 of the mounting frame 11 sits flush within the vessel threshold (if applicable). The folded ladder portion (12, 13, and 14) is then carried, or slidably moved along the deck surface, to the modified deck area 17. Sliding is facilitated by the rounded edges (shown as 13*a* and 13*b* in FIG. 1). The folded ladder portion (12, 13, and 14) is then positioned inboard of the mounting platform 11 and, optionally, secured to the vessel 18 via ladder-safety-straps 12*a*, 12*b*. The ladder portion (12, 13, and 14) is then unfolded to its open position and seated on the rollers 25 and 26 so that the rollers 25 and 26 enter each slot opening 33. The opened ladder portion (12, 13, and 14) is then rolled along the rollers 25 and 26 though each elongated slot 33 and securely maintained at the closed end of the elongated slot 33 for deployment alongside the vessel 18. Because the rollers 25 and 26 securely grasp the inside of the elongated slot 33 when the ladder portion (12, 13, and 14) is yet on the deck 17, there is little opportunity for the ladder portion (12, 13, and 14) to be dangled from the deck 17 or be lost overboard. Further, use of the optional frame-safety-safety-straps 11*a*, 11*b* and ladder-safety-straps 12*a*, 12*b* substantially eliminates any possibility of losing the system 10 overboard.

It should be understood that, while the preferred embodiment mentioned here is intended to illustrate the present invention, minor changes will become apparent to those skilled in the art. Accordingly, numerous variations in design and use of the present invention may be contemplated in view of the following claims without straying from the intended scope and field of the invention herein disclosed.

I claim:

1. A ladder system adapted to connect to a deck portion of a marine vessel, said ladder system comprising:

a) an upper ladder means for providing a first vertical path, said upper ladder means including two parallel rails, each one of said two parallel rails including an outer surface having an elongated slot therein;

b) a lower ladder means for providing a second vertical path;

c) a platform, said platform being substantially one piece and distinct from both said upper ladder means and said lower ladder means, wherein said platform is movably contiguous with said upper ladder means and said lower ladder means; and d) a coupling means for connecting said upper ladder means to said deck portion, wherein said coupling means includes a frame having one or more cross-bars and two lateral elements, two rollers mounted inside said frame, each of said two rollers being mounted to a respective one of said two lateral elements, and footing means for removably securing said frame to said deck portion of said marine vessel, wherein each said elongated slot includes a first cross-section shape that substantially conforms to a second cross-section shape of either of said two rollers so as to permit said upper ladder means to slide between said lateral elements of said frame.

2. The ladder system as claimed in claim 1, wherein each said elongated slot includes an open area near a first end of each of said two parallel rails and a closed area near a second end of each of said two parallel rails so that said two rollers are permitted to enter each said elongated slot at said first end of each of said two parallel rails and roll along each said elongated slot until each of said two rollers reaches said closed area at said second end of each of said two parallel rails where each of said two rollers is securely maintained.

3. The ladder system as claimed in claim 2 further comprising:

a) a pair of hand-grips, one of said hand-grips located on each said of said two parallel rails, b) a pair of fittings, each fitting slidably situated upon each of said hand-grips, and c) a pair of lateral guides, each lateral guide having a hinge movably attached to each said fitting.

4. The ladder system of claim 3 wherein said ladder system is constructed from aluminum.

5. A ladder system adapted to be secured to a modified deck area of a marine vessel, said ladder system comprising:

a) a ladder, said ladder including an upper-ladder-section having a pair of hand-grips, a middle-platform, and a lower-ladder-section, all foldably hinged together in series;

b) a coupler, said coupler including two rollers, a frame having two cross-bars and two lateral elements, and a footing means for removably securing said frame to said modified portion of said marine vessel, wherein each of said two rollers is mounted inside said frame to a respective one of said two lateral elements, and wherein said two rollers are connectable to said upper-ladder-section so as to secure said ladder to said modified deck area of said marine vessel via said coupler;

c) a pair of fittings, each of said pair of fittings being slidably situated upon each of said pair of hand-grips; and d) a pair of lateral guides, each of said pair of lateral guides having a hinge located on a first end thereof and being pivotally attached to each of said pair of fittings.

6. The ladder system as claimed in claim 5 further comprising four lower fittings, where two of said four lower fittings are affixed to a first side of said lower-ladder-section and two of said four lower fittings are affixed to a second side of said lower-ladder-section, wherein each one of said lateral guides has a second end that is connectable to at least one of said four lower fittings.

7. The ladder system as claimed in claim 6 further comprising one or more safety straps, where said one or more safety straps are connectable to said ladder system so as to secure said ladder system to said marine vessel.

8. The ladder system of claim 6 wherein said ladder system is constructed from aluminum.

9. A method of providing emergency access between a marine vessel and a surface of water consisting of the steps:

a) releasing a foldable ladder portion from a secured position by removing a mounting frame;

b) placing said mounting frame into a coupling position at a modified deck area of said marine vessel;

c) removing said foldable ladder portion to said modified deck area such that substantially all of said foldable ladder portion is movably secured on deck;

d) substantially unfolding said foldable ladder portion;

e) connecting said foldable ladder portion to rollers located on said mounting frame; and f) rolling said foldable ladder portion along said rollers and into position alongside said modified deck area.

10. The method as claimed in claim 9 wherein said deploying step includes:

a) securing frame-straps between said mounting frame and said marine vessel;

b) securing ladder-straps between said foldable ladder portion and said marine vessel;

c) substantially unfolding said foldable ladder portion, d) connecting said foldable ladder portion to rollers located on said mounting frame, and e) rolling said foldable ladder portion along said rollers and into position alongside said modified deck area.

* * * * *